United States Patent [19]

Butler

[11] Patent Number: 4,832,196

[45] Date of Patent: May 23, 1989

[54] PACKAGING SYSTEM FOR MATERIAL ROLLS AND IMPROVED STRUCTURE FOR USE THEREIN

[75] Inventor: Richard M. Butler, Menasha, Wis.

[73] Assignee: Great Northern Corporation, Appleton, Wis.

[21] Appl. No.: 158,403

[22] Filed: Feb. 22, 1988

[51] Int. Cl.[4] ..... B65D 81/06

[52] U.S. Cl. ..... 206/391; 206/394; 206/443; 206/593

[58] Field of Search ..... 206/389, 391, 394, 443, 206/523, 589, 590, 497, 598, 593; 285/22

[56] References Cited

U.S. PATENT DOCUMENTS

| | | | |
|---|---|---|---|
| 2,007,914 | 7/1935 | Elling | 206/394 |
| 2,409,865 | 10/1946 | Jewell | 285/22 |
| 3,294,225 | 12/1966 | Kenyon | 206/523 |
| 4,099,617 | 7/1978 | Nist, Jr. | 206/443 |
| 4,195,732 | 4/1980 | Bell | 206/391 |
| 4,332,326 | 6/1982 | Kelly et al. | 206/497 |
| 4,435,463 | 3/1984 | Roellchen | 206/391 |

FOREIGN PATENT DOCUMENTS

| | | | |
|---|---|---|---|
| 472703 | 2/1929 | Fed. Rep. of Germany | 206/394 |

*Primary Examiner*—David T. Fidei

*Attorney, Agent, or Firm*—Andrus, Sceales, Starke & Sawall

[57] ABSTRACT

An improved supporting and spacing member for packaging a multi-layer stack of rolls of material. The supporting and spacing member includes an elongated bar of expanded foam material with a stabilizing member located within a semi-cylindrical indentation to provide a pair of indentation portions to retain opposing roll ends for added flexural stiffness and better stability for the stack.

7 Claims, 2 Drawing Sheets

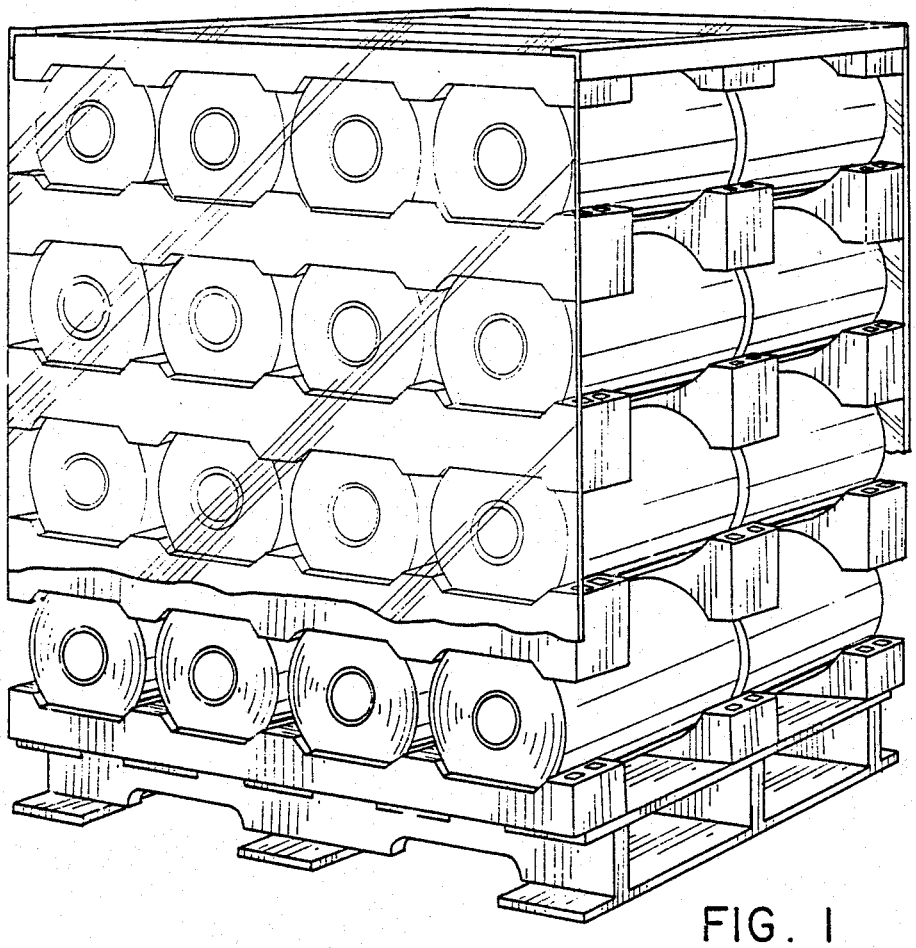
FIG. 1
FIG. 2
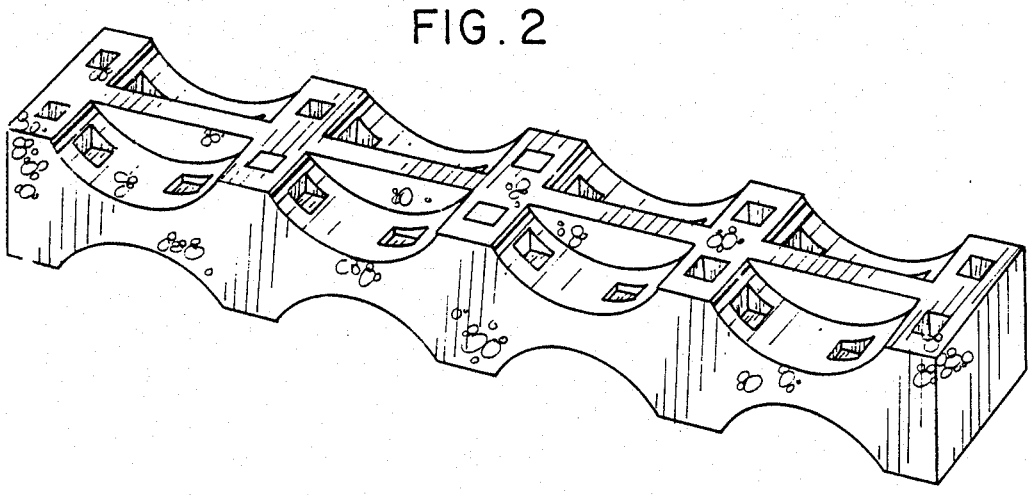

PACKAGING SYSTEM FOR MATERIAL ROLLS AND IMPROVED STRUCTURE FOR USE THEREIN

BACKGROUND OF THE INVENTION

The present invention relates to a packaging system for shipping rolls of material and to an improved support and spacing structure for use in the system.

The U.S. Pat. No. 4,195,732 (Bell), which is assigned to the assignee of this application, discloses a highly successful roll spacing and supporting structure including an elongated bar of expanded foam material, such as polystyrene, for use in palletizing rolls of material and protecting such rolls against damage in handling and shipment. Such elongated bar provides a plurality of spaced semi-cylindrical indentations along at least one of the surfaces for receiving rolls of material. Further, such an elongated bar of expanded foam material includes a plurality of recesses located within or adjacent to the side portions of the semi-cylindrical indentations to provide flexural cushioning. The bars of the Bell patent permit limited relative movement among the rolls of the stack while, at the same time, are of sufficient strength to prevent crushing and collapse of the stack. Also, the Bell patent discloses one embodiment which provides an integral lip along the outside edge of a semi-cylindrical indentation of a supporting bar to protect an otherwise exposed end of a material roll from damage.

In use, the elongated bars of the Bell patent may be placed between the bottom layer of rolls and the supporting pallet, between each layer of rolls in the stack, and on top of the stack. In one form of stacking arrangement, each layer contains a number of rolls of material arranged in parallel and axial orientation. The supporting bars may be arranged parallel to one another and spaced apart with the end portions of each roll supported in a semi-circular indentation provided by adjacent spaced bars.

The bars located in the interior of a stack as disclosed in the Bell patent receive and support the ends of axially adjacent rolls. In other words, a semi-cylindrical indentation provided by an interiorly located bar may be required to support the end portions of two rolls of material. Movement of the rolls within the stack has been minimized by securing a palletized stack with strapping and stretch wrap film.

The elimination of strapping from a pallet containing a multi-layer stack under certain loading configurations has been found to cause alignment problems within the stack because of vibrations of the type experienced during shipping and handling. Slight movements between the components of the stack may be caused by tilting, jarring, or similar forces encountered in shipping, which might result in either a roll or a supporting bar shifting within the stack. If such movement becomes large enough, the relative axial displacement of a roll may cause it to drop off a supporting bar. Alternatively, such movement may cause the rolls to be pushed together which might cause damage to the roll ends. The invention set forth herein provides a solution to these problems.

SUMMARY OF THE INVENTION

The present invention is directed to an improved roll-supporting bar and to a packaging system for rolls utilizing the improved bar construction. A supporting bar includes a stabilizing member located within a semi-cylindrical indentation formed of cushioning material to divide the indentation into first and second roll retaining portions. When used in the interior of a multilayer stack, a bar incorporating such a stabilizing member will permit limited lateral and vertical flexure, and provide a barrier between adjacent roll ends. Use of a stabilizing member in a semi-cylindrical indentation provides greater stability to the stack and limits roll displacement.

The stabilizing member provides spaced surfaces which may engage the roll ends to maintain physical separation thereof and avoid damage which might otherwise result from contact between the rolls. Thus, the abutment by axially adjacent roll ends with opposite faces of the stabilizing member, particularly when subject to the influence of an inwardly directed force such as provided by stretch film surrounding the entire palletized stack, provides a structural continuity across each layer of the stack for added stability.

The stabilizing member imparts added flexural stiffness to the supporting bar both across a semi-cylindrical indentation and along the longitudinal direction of the bar. On the other hand, the stability member permits the continued usage of the plurality of recesses located within or adjacent to the side portions of the semi-cylindrical indentations to provide flexural cushioning.

BRIEF DESCRIPTION OF THE DRAWINGS

FIG. 1 is a perspective view of a multilayer stack of palletized rolls utilizing the improved supporting and spacing bars and packaging system of the present invention;

FIG. 2 is a perspective view of the improved supporting and spacing bar of the present invention;

DETAILED DESCRIPTION OF THE PREFERRED EMBODIMENT

Figure 3:
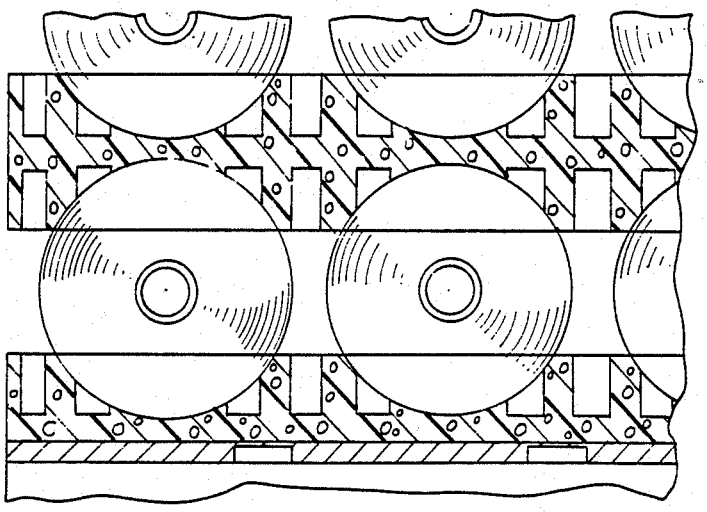
FIG. 3 is a partial vertical section through the palletized stack of rolls taken on line 3—3 of FIG. 1.

The supporting and spacing members 10 are designed to support and space a plurality of rolls 12 of material, such as stretch film or other thin material, on a storage and shipping support, such as a pallet 14. The rolls 12 are typically arranged in multi-roll layers, such as layers 12*a*, 12*b*, 12*c*, and 12*d*, which in turn are arranged in a multilayer stack. The supporting and spacing members 10 are placed on the pallet 14 beneath the lowermost layer 12*a*, between layer 12*a* and intermediate layer 12*b*, between intermediate layer 12*b* and intermediate layer 12*c*, between intermediate layer 12*c* and uppermost layer 12*d*, and on top of the uppermost layer 12*d*. The stack is secured to the pallet 14 by enclosing the pallet and stack with a stretch film 18. Reinforcing edge strips 16 may be placed along the lateral upper edge of the uppermost members 10 on the stack. Optionally, the stack may be banded to the pallet with straps (not shown).

The supporting and spacing members 10 are each formed as an elongated bar of cushioning material such as expanded foam. One type of members 10 is shown in FIG. 2 as a bar 20 which is particularly suitable for use as one of the interior supporting and spacing members 21 to be located within the stack. The outer supporting and spacing members 23 are used to space and support the roll ends at the outside of the stack and may be of a construction as disclosed in the Bell patent. For example, the outer members 23 shown in FIG. 1 provide an outer protective lip 23*a* which is similar to the lip illustrated in the Bell patent.

Figure 5:
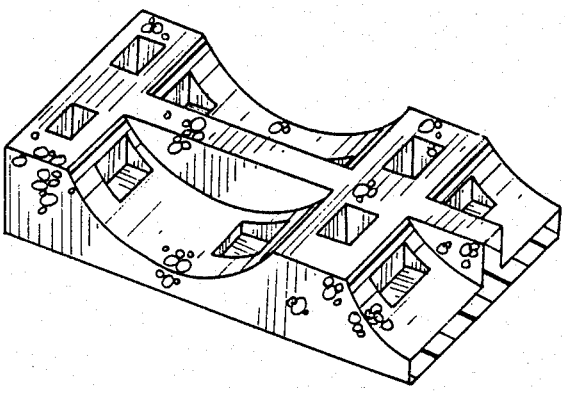
FIG. 5 is a perspective view of a portion of the supporting and spacing bar having roll-receiving indentations on only one surface for use at the top and bottom of the stack shown in FIG. 1.

Each interior member 21 includes a plurality of spaced semi-cylindrical indentations 22 formed of cushioning material (e.g. expanded foam) which are separated by lands 24. The interior members 21 which are intended for use between layers 12 of rolls 10 include spaced indentations 22 on opposite surfaces, as shown in FIG. 2. The interior members 21 used under the lowermost layer 12*a* and above the uppermost layer 12*d* have semi-cylindrical indentations 22 only on one surface as shown in FIG. 5. The two types of interior members 21 are also shown in FIG. 3. The interior members 21 are provided with a plurality of recesses 26 which are located in the lands 24 and in or adjacent to the side portions of the indentations 22 for flexural cushioning of the rolls 12. The cushioning recesses could be formed as internal voids enclosed within the expanded foam material of the bars.

Figure 4:
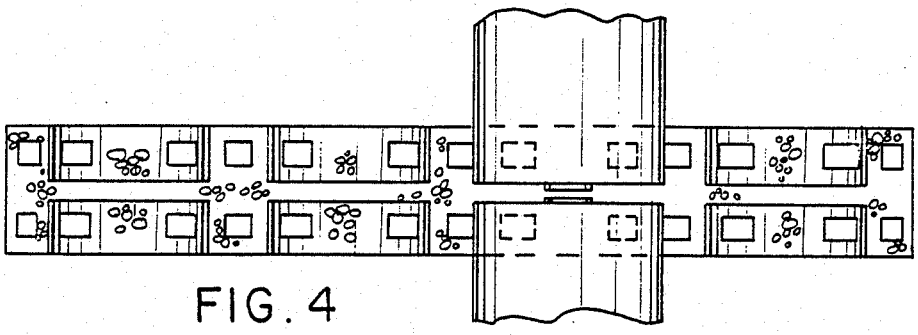
FIG. 4 is a top plan view of the supporting and spacing bar shown in FIG. 2 and additionally showing the ends of two axially spaced rolls supported thereon.

To provide enhanced stability to the stack and added flexural stiffness to the member 21, each interior member 21 includes a stabilizing member 25 within each semi-cylindrical indentation 22. Each member 25 is located generally perpendicular to the axes of the indentation and divides each indentation into a pair of axially spaced semi-cylindrical indentation portions 22*a* and 22*b*. The stabilizing member 25 spans the indentation 22 between adjacent lands 24 such that the outer surface 27 of the member 25 lies coplanar with the surface of the lands 24. It may be possible, however, to utilize a stabilizing member 25 which does not entirely span the indentation 22 and/or does not lie coplanar with the surface of the lands 24. The spaced parallel faces 29 of the member 25 may be engaged by the ends of adjacent rolls 12, as illustrated in FIG. 4. Some rolls 12 of material have cores 30 which extend axially beyond the roll ends of film, as shown in FIG. 4. In that the radius of each indentation is greater than the depth thereof, the surface 27 of stabilizing member 25 would not generally engage a core 30 when a roll 12 is placed therein. In other words, a core end may be above or below the surface 27 of member 25. When used in either manner, the stabilizing member 25 prevents adjacent roll cores 30 from engaging each other. In such manner, the roll cores 30 are protected so the rolls may eventually be mounted and properly operate on unwinding equipment.

The stabilizing member 25 imparts a highly desirable flexural stiffness to the member 21. The increase in flexural stiffness helps strengthen the member against deflection from forces. The stabilizing member 25 substantially reduces or eliminates the tendency of the interior members 21 to "walk" or creep along the rolls as a result of conventional transportation vibration and shock. The stabilizing member 25 not only functions as a solid spacer, but also as a flexural stiffener to maintain structural integrity and rigidity of the stack.

With the rolls 12 stacked in layers utilizing the interior members 21 as described above and outer members 23 as described in the Bell patent, the stack is wrapped in a film to impose an inwardly directed force to secure the entire palletized load. Such force will tend to urge adjacent rolls which are supported by an interior member 21 into engagement with the faces 29 of the stabilizing member 25. Additionally, the stabilizing membrane 25 assists as a locator to center each roll as its end is placed in an indentation 22*a* or 22*b*. It has been found that a palletized stack utilizing internal bars 21 with a stabilizing member 25 can maintain its integrity by being wrapped with a stretch film 18 without conventional strapping thereby providing an economic advantage by eliminating the expense of labor and materials involved with strapping. Of course, the invention could also be utilized with strapping if desired.

The improved supporting and spacing member and packaging system of the present invention provides substantially enhanced stability to the stack without sacrificing flexural cushioning for the supporting and spacing members.

Various modes of carrying out the invention are contemplated as being within the scope of the following claims particularly pointing out and distinctly claiming the subject matter which is regarded as the invention.

I claim:

1. A packaging system for securing rolls of material in a multi-layer stack of multi-roll layers, each layer including pairs of rolls located in axial orientation, said system comprising elongated bars of expanded foam material, each bar having a pair of opposite surfaces, a first of said surfaces having a plurality of spaced parallel generally semi-cylindrical indentations disposed to receive rolls of material, the radius of each of said indentations being greater than the depth thereof, whereby the rolls of a layer will be snuggly retained within indentations in a vertically disposed pair of said bars and the bars will be out of contact with each other, the semi-cylindrical indentations of each of the bars on the interior of a layer receiving the opposed end portions of axially adjacent rolls, a stabilizing member within the semi-cylindrical indentations of each interior bar, each stabilizing member disposed generally perpendicular to the axes of the indentations and dividing the same into a pair of semi-cylindrical indentation portions, the stabilizing members of each bar being in alignment and the ends of each pair of said axially adjacent rolls being in non-rotatable bearing engagement with opposite surfaces of a stabilizing member, and means for wrapping the stack of rolls to impose an inwardly directed axial force on each of said axially adjacent rolls to maintain the ends of the axially adjacent rolls in engagement with the stabilizing member.

2. The system as set forth in claim 1, wherein the wrapping means comprises a stretch-wrap film.

3. In a shipping structure, a pair of elongated bars each having a surface including a generally semi-cylindrical indentation, the surfaces of said bars being disposed in facing relationship and said indentations being aligned, a stabilizing rib within each indentation, each rib being disposed generally perpendicular of the axis of the respective indentation and dividing said indentation into a pair of semi-cylindrical indentation sections, each rib having a pair of longitudinal sides, a pair of axially aligned rolls, each roll including a central core and a coil of material wound on said core, the end portions of said axially aligned rolls being disposed within said indentation sections and the ends of the coil of material of each roll being disposed in non-rotatable bearing engagement with a side of said rib, the radius of each indentation being greater than the depth thereof whereby said surfaces are spaced apart, each rib having a depth such that the rib of one bar is spaced from the rib on the other bar and the ends of the cores of the axially aligned rolls are aligned with the space between said ribs, said ribs having a lateral width such that the cores of said axially aligned rolls are spaced axially apart.

4. The system of claim 3, wherein the ends of said core project axially beyond the corresponding ends of the coil of material.

5. The system of claim 3, wherein each bar includes a land disposed between adjacent indentations, the outer extremities of said ribs being flush with the outer extremity of said lands.

6. The system of claim 3, wherein the ribs of each bar are aligned longitudinally.

7. A structure for protectively supporting and spacing rolls of web material in a multi-layer stack, comprising an elongated bar of expanded foam material having a pair of opposed surfaces, a first of said surfaces having a plurality of spaced parallel generally semi-cylindrical indentations disposed to receive rolls of web material, the radius of each of said semi-cylindrical indentations being greater than the depth of said indentations, whereby the rolls will be snuggly retained within indentations in a pair of bars and the bars will be out of contact with each other, said bar having a stabilizing member located in at least one of said indentations and disposed longitudinally of said bar, said stabilizing member dividing said indentation into a pair of semi-cylindrical indentation portions to receive the end portions of a pair of axially aligned rolls, said stabilizing member having generally parallel opposed side surfaces to be engaged by the ends of the respective axially aligned rolls.

* * * * *